US007744702B2

(12) United States Patent
Tomita et al.

(10) Patent No.: US 7,744,702 B2
(45) Date of Patent: Jun. 29, 2010

(54) SOFT MAGNETIC ALLOY POWDER, COMPACT, AND INDUCTANCE ELEMENT

(75) Inventors: Hiroshi Tomita, Tokyo (JP); Hideharu Moro, Tokyo (JP); Kesaharu Takatoh, Tokyo (JP); Koyu Enda, Tokyo (JP)

(73) Assignee: TDK Corporation, Tokyo (JP)

( * ) Notice: Subject to any disclaimer, the term of this patent is extended or adjusted under 35 U.S.C. 154(b) by 196 days.

(21) Appl. No.: 11/976,029

(22) Filed: Oct. 19, 2007

(65) Prior Publication Data

US 2008/0100410 A1 May 1, 2008

(30) Foreign Application Priority Data

Oct. 31, 2006 (JP) ..... 2006-296533
Mar. 29, 2007 (JP) ..... 2007-088875

(51) Int. Cl.
*H01F 1/147* (2006.01)

(52) U.S. Cl. ..... 148/313; 148/312; 148/315; 148/307; 420/581; 420/459; 420/95

(58) Field of Classification Search ..... None
See application file for complete search history.

(56) References Cited

U.S. PATENT DOCUMENTS 6,656,419 B2 12/2003 Itoh et al.
7,132,019 B2 * 11/2006 Koshiba et al. ..... 148/304
2002/0068007 A1 6/2002 Itoh et al.
2005/0095402 A1 * 5/2005 Kaizu et al. ..... 428/167
2006/0170524 A1 * 8/2006 Fujiwara et al. ..... 336/83

FOREIGN PATENT DOCUMENTS

| | | |
|---|---|---|
| JP | A-55-059702 | 5/1980 |
| JP | A-56-013714 | 2/1981 |
| JP | A-62-099402 | 5/1987 |
| JP | A 63-114108 | 5/1988 |
| JP | A-04-116103 | 4/1992 |
| JP | A-2000-239702 | 9/2000 |
| JP | A 2001-023811 | 1/2001 |
| JP | A-2002-080949 | 3/2002 |
| JP | A 2002-173745 | 6/2002 |
| JP | A-2003-229311 | 8/2003 |

* cited by examiner

*Primary Examiner*—John P Sheehan
(74) *Attorney, Agent, or Firm*—Oliff & Berridge, PLC

(57) ABSTRACT

A soft magnetic alloy powder containing Fe—Ni-based crystal particles is provided as one capable of adequately reducing core loss of a powder magnetic core and achieving satisfactory magnetic characteristics at an effective operating temperature of an element. The present invention provides a soft magnetic alloy powder containing Fe—Ni-based crystal particles containing 45 to 55 mass % Fe and 45 to 55 mass % Ni, relative to a total mass of Fe and Ni, and containing 1 to 12 mass % Co and 1.2 to 6.5 mass % Si, relative to a total mass of Fe, Ni, Co, and Si.

5 Claims, 10 Drawing Sheets

SOFT MAGNETIC ALLOY POWDER, COMPACT, AND INDUCTANCE ELEMENT

BACKGROUND OF THE INVENTION

1. Field of the Invention

The present invention relates to a soft magnetic alloy powder, a compact, and an inductance element.

2. Related Background Art

Conventionally, a powder magnetic core is generally used as a type of magnetic core provided in an inductance element or the like. An Fe-based soft magnetic metal powder being a soft magnetic material is often used as a material of this powder magnetic core. Since the material of the Fe-based soft magnetic metal powder itself has low electric resistance, core loss becomes relatively high even if insulation between particles is enhanced. In recent years, according to the demand for downsizing of the inductance element or the like, it is to be desired that the electric resistance of the powder magnetic core is increased to decrease the core loss. For this reason, a further improvement is demanded for the conventional soft magnetic materials as described above. A technique of adding Si (silicon) in the metal powder was proposed in order to increase the electric resistance of the Fe-based soft magnetic metal powder. However, the addition of Si increases the hardness of the Fe-based soft magnetic metal powder, and thus moldability thereof becomes insufficient for the powder magnetic core and unsuitable for practical use.

Fe—Ni-based soft magnetic alloy (so-called permalloy alloy) powders are often adopted as materials of the powder magnetic core other than the Fe-based soft magnetic metal powder. However, reduction of core loss at high frequencies is insufficient in the Fe—Ni-based soft magnetic alloy powders. Then means of adding Si, Ge, or Sn being the Group 14 element was proposed for the purpose of reducing the core loss of the Fe—Ni-based soft magnetic alloy powders (cf. Patent Document 1). According to Patent Document 1, the electric resistance of the material itself increases when a predetermined amount of the Group 14 element such as Si is added in the Fe—Ni-based soft magnetic alloy powder.

Another example of addition of Si in the permalloy alloy likewise is the one disclosed in Patent Document 2. According to Patent Document 2, influence of oxygen on magnetic characteristics can be reduced by adding Si as a deoxidizing component. However, Patent Document 2 describes that Si should be limited to not more than 1 wt % because excessive addition of Si is harmful to the soft magnetic property. This Patent Document 2 also describes that Co may be added in the permalloy alloy in order to enhance the magnetic flux density or the like.

Patent Document 3 discloses use of Cr, Si, Cu, and Co as additive elements in the PC permalloy alloy, but describes nothing about an additive amount thereof.

[Patent Document 1] Japanese Patent Application Laid-Open No. 2001-23811

[Patent Document 2] Japanese Patent Application Laid-Open No. 2002-173745

[Patent Document 3] Japanese Patent Application Laid-Open No. 63-114108

SUMMARY OF THE INVENTION

Problem to be Solved by the Invention

The inventors conducted detailed investigation on the conventional Fe—Ni-based soft magnetic alloy powders described in the above patent documents. As a result of the research, the inventors found that the addition of the predetermined amount of Si alone in the Fe—Ni-based soft magnetic alloy powder, as proposed in Patent Document 1, considerably decreased the Curie temperature (Tc) and saturation flux density (Bs). Such soft magnetic materials undergo degradation of magnetic characteristics at effective operating temperatures of the element in use as a powder magnetic core in the inductance element or the like, and are not sufficient yet for practical use. Furthermore, the permalloy alloy disclosed in Patent Document 2 is insufficient in reduction of core loss and there is still room for further improvement.

The present invention has been accomplished in view of the above-described circumstances and an object of the invention is to provide a soft magnetic alloy powder containing Fe—Ni-based particles, capable of adequately reducing the core loss of the powder magnetic core and achieving satisfactory magnetic characteristics at effective operating temperatures of an element (which will also be referred to as "high-temperature characteristics"), a compact containing the powder, and an inductance element using the compact.

Means for Solving the Problem

In order to achieve the above object, the present invention provides a soft magnetic alloy powder comprising Fe—Ni-based particles containing 45 to 55 mass % Fe and 45 to 55 mass % Ni, relative to a total mass of Fe and Ni, and containing 1 to 12 mass % Co and 1.2 to 6.5 mass % Si, relative to a total mass of Fe, Ni, Co, and Si.

According to the present invention, first, the permalloy type crystal particles having the above composition of Fe and Ni contain 1.2 to 6.5 mass % Si to increase the intraparticle resistance, whereby sufficient reduction in the core loss is achieved not only in the low frequency region but also in the high frequency region. The permalloy type alloy powder in the composition including this amount of Si fails to exhibit good high-temperature characteristics in a state in which Si alone is added. The inventors conducted further elaborate research and discovered that satisfactory high-temperature characteristics could be achieved when the permalloy type crystal particles containing the predetermined amount of Si further contained the predetermined amount of Co, thereby accomplishing the present invention. Namely, the soft magnetic alloy powder of the present invention has sufficiently high values of saturation magnetization and Curie temperature (Tc) from a practical aspect. For this reason, this soft magnetic alloy powder exhibits satisfactory magnetic characteristics even in the high temperature region where electronic equipment operates. The addition of Co also permits the soft magnetic alloy powder of the present invention to achieve further reduction of the core loss.

The soft magnetic alloy powder of the present invention contains 1.2 mass % or more Si in crystals. As described above, it is known that when the Fe-based soft magnetic metal powder contains Si, its hardness increases. In the present invention, however, the hardness is kept low, in spite of the inclusion of the predetermined amount of Si. For this reason, the soft magnetic alloy powder of the present invention is a metal powder with excellent moldability into the powder magnetic core and thus has high practicality. This soft magnetic alloy powder can exhibit high magnetic permeability mainly because it contains 1.2 mass % or more Si. Furthermore, this soft magnetic alloy powder demonstrates an excellent superimposed DC current characteristic mainly because it contains Co.

In the soft magnetic alloy powder of the present invention, preferably, the Fe—Ni-based particles have an average particle size of more than 10 μm and less than 100 μm. This permits the soft magnetic alloy powder of the present invention to have the following effects all together: low coercivity and high magnetic permeability excellent as a soft magnetic material, ease of handling, and reduction in eddy-current loss.

The present invention also provides a compact comprising Fe—Ni-based particles a part or whole of a surface of which is coated with an insulator, wherein the Fe—Ni-based particles contain 45 to 55 mass % Fe and 45 to 55 mass % Ni, relative to a total mass of Fe and Ni, and contain 1 to 12 mass % Co and 1.2 to 6.5 mass % Si, relative to a total mass of Fe, Ni, Co, and Si. Since this compact contains the aforementioned Fe—Ni-based particles according to the present invention, the core loss is adequately reduced over the range from the low frequency region to the high frequency region and it exhibits satisfactory magnetic characteristics even in the high temperature region where electronic equipment operates.

The present invention provides an inductance element comprising a powder magnetic core comprised of a compact, wherein the compact comprises Fe—Ni-based particles a part or whole of a surface of which is coated with an insulator, wherein the Fe—Ni-based particles contain 45 to 55 mass % Fe and 45 to 55 mass % Ni, relative to a total mass of Fe and Ni, and contain 1 to 12 mass % Co and 1.2 to 6.5 mass % Si, relative to a total mass of Fe, Ni, Co, and Si. Since the inductance element of the present invention has the powder magnetic core comprised of the compact comprising the Fe—Ni-based particles according to the present invention, the core loss is adequately reduced over the range from the low frequency region to the high frequency region at its operating temperature and it has sufficiently high inductance density.

The present invention also provides an inductance element comprising a powder magnetic core comprised of a compact, and a coil buried in the powder magnetic core, wherein the compact comprises Fe—Ni-based particles a part or whole of a surface of which is coated with an insulator, wherein the Fe—Ni-based particles contain 45 to 55 mass % Fe and 45 to 55 mass % Ni, relative to a total mass of Fe and Ni, and contain 1 to 12 mass % Co and 1.2 to 6.5 mass % Si, relative to a total mass of Fe, Ni, Co, and Si. Since this inductance element can minimize a space in the element, it becomes feasible to meet the demand for further downsizing.

Effect of the Invention

The present invention successfully provides the soft magnetic alloy powder containing the Fe—Ni-based particles, capable of adequately reducing the core loss of the powder magnetic core and achieving satisfactory magnetic characteristics at the effective operating temperature of the element, the compact containing the powder, and the inductance element using the compact.

DESCRIPTION OF REFERENCE SYMBOLS

Figure 2:
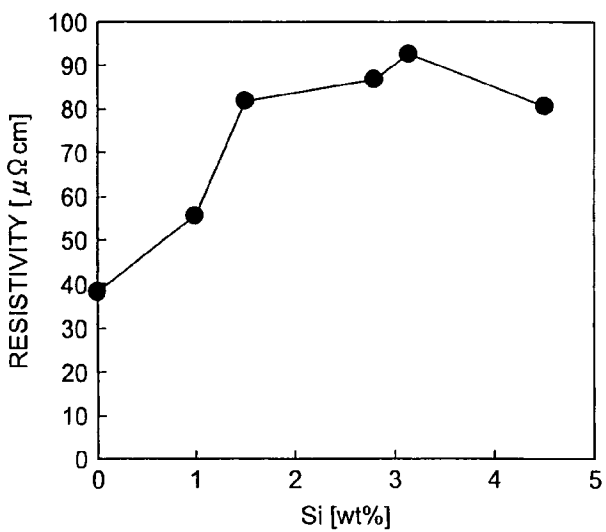
FIG. 2 is a plot of intraparticle resistances of soft magnetic alloy powders in Examples.

100 inductance element, 110 core, and 120 coil.

DESCRIPTION OF THE PREFERRED EMBODIMENTS

The preferred embodiments of the present invention will be described below in detail with reference to the drawings according to need. The same elements will be denoted by the same reference symbols throughout the drawings, without redundant description. The vertical, horizontal, and other positional relations are based on those shown in the drawings unless otherwise specified. It is further noted that the dimensional ratios in the drawings are not limited to those shown in the drawings.

Figure 1:
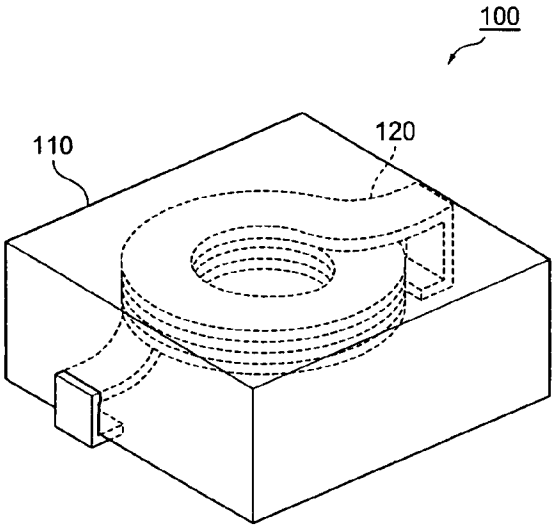
FIG. 1 is a schematic perspective view showing an inductance element according to the present invention.

FIG. 1 is a schematic perspective view showing an inductance element according to a preferred embodiment of the present invention. The inductance element 100 has a core 110 integrally formed in a hexahedral shape whose faces are continuous perpendicularly to each other as shown in FIG. 1, and a coil 120 buried in this core 110 and exposed only at two ends thereof.

The coil 120 is formed by winding a rectangular metal wire whose cross section is a flat rectangle, in such a spiral shape that one shorter side of the rectangle is located on the center side. The two ends of the coil 120 are drawn out of the wound part. The periphery of the coil 120 is coated with an insulating layer. The two ends of the coil 120 project outwardly from intermediate portions in the height direction of two side faces parallel to each other in the core 110. These two ends are first bent from the wound part so as to extend along the side faces of the core 110, and further bent at their distal end so as to extend along the back face of the core 110. Since the two ends of the coil 120 function as terminals, they are not covered by the insulating layer.

There are no particular restrictions on materials of the coil 120 and the insulating layer coating it, as long as they are materials of the corresponding coil and insulating layer of the conventional inductance elements.

The core 110 of this inductance element 100 is comprised of a compact according to the present invention. The core 110 is a compact (press-molded body) press-molded with a die (shaping die) of a press machine which is a compression molding machine not shown. The coil 120 is one located as positioned in the die before molding of the core 110 and buried in the core 110 integrally therewith on the occasion of press-molding of the core 110.

The core 110 is fabricated by adding an insulating material (insulator) into a soft magnetic alloy powder of the present invention, mixing them, and then pressing the mixture under predetermined conditions. For this reason, the soft magnetic alloy powder is coated with the insulator in the core 110. Preferably, the soft magnetic alloy powder with the insulator therein is dried and then a lubricant is further added and mixed in the soft magnetic powder after dried.

The soft magnetic alloy powder contains Fe—Ni-based particles containing 45 to 55 mass % Fe and 45 to 55 mass % Ni, relative to a total mass of Fe and Ni, and containing 1 to 12 mass % Co and 1.2 to 6.5 mass % Si, relative to a total mass of Fe, Ni, Co, and Si. The Fe—Ni-based particles are particles having a crystal structure of the face-centered cubic lattice.

The relative proportions of Fe and Ni in the Fe—Ni-based particles are 45 to 55 mass % Fe and 45 to 55 mass % Ni, relative to the total mass of Fe and Ni. If the content of Ni is smaller than 45 mass % (or if the content of Fe is over 55 mass %), the saturation flux density will become too small and the Curie temperature will become too low, when compared with those in the case where the content of Ni falls within the range of 45 to 55 mass %. If the content of Ni is over 55 mass % (or if the content of Fe is smaller than 45 mass %), the electric resistance and saturation magnetization of the powder itself will become too small, when compared with those in the case where the content of Ni falls within the range of 45 to 55 mass %. When the content of Ni is in the range of 45 to 55 mass %, the soft magnetic alloy powder has the hardness low enough to ensure sufficient moldability and is thus applicable to the powder magnetic core.

The content of Ni is preferably 45 to 50 mass % and more preferably 47 to 48 mass %, relative to the total mass of Fe and Ni. This enables a further improvement in the high-temperature characteristics of the powder magnetic core in a composition in which the contents of Si and Co are relatively small, and a further increase of the Curie temperature.

The content of Co is 1 to 12 mass % relative to the total mass of Fe, Ni, Co, and Si. If the content of Co is less than 1 mass %, the Curie temperature will become lowered and the saturation magnetization of the soft magnetic alloy powder will decrease, particularly, in a small Si content region, when compared with those in the case where the content of Co is in the range of 1 to 12 mass %. For this reason, the magnetic characteristics of the soft magnetic alloy powder will become insufficient at operating temperatures of electronic equipment. Furthermore, the superimposed DC current characteristic of the powder magnetic core will degrade. On the other hand, if the content of Co exceeds 12 mass %, the coercivity will increase, the soft magnetic property of the soft magnetic alloy powder will degrade, and it will be difficult to reduce hysteresis loss. Since there will be no further improvement in the Co adding effect, such a material will not suit a practical powder magnetic core. From the same viewpoint, the content of Co is preferably 3 to 6 mass % relative to the total mass of Fe, Ni, Co, and Si.

The content of Si is 1.2 to 6.5 mass % of the total mass of Fe, Ni, Co, and Si. If the content of Si is smaller than 1.2 mass %, reduction of core loss will be insufficient and influence thereof will become prominent, particularly, in the high-frequency region, when compared with those in the case where the Si content falls within the range of 1.2 to 6.5 mass %. In addition, the magnetic permeability of the soft magnetic alloy powder will decrease. On the other hand, if the content of Si is over 6.5 mass %, the reduction effect of core loss will become saturated and the saturation flux density and the Curie temperature will become lowered, when compared with those in the case where the content of Si falls within the range of 1.2 to 6.5 mass %. As a result, the magnetic characteristics will be insufficient at high temperatures where electronic equipment operates. Since the soft magnetic alloy powder of the present invention contains 1.2 to 6.5 mass % Si, the hardness can be kept low enough to be adequately applicable to the powder magnetic core. From the same viewpoint, the content of Si is preferably 1.5 to 6.5 mass % and more preferably 1.5 to 3 mass %.

The Fe—Ni-based particles according to the present invention may contain an unavoidable impurity.

There are no particular restrictions on the shape of the soft magnetic alloy powder, but, from a viewpoint of maintaining inductance up to a high magnetic field region, the shape is preferably a sphere or an ellipsoid. Among these, the shape is preferably an ellipsoid in terms of making the strength of the powder magnetic core stronger. An average particle size of the soft magnetic alloy powder is preferably more than 10 μm and less than 100 μm and more preferably 15 to 75 μm. If the average particle size is not more than 10 μm, the magnetic permeability will become lower, the magnetic characteristics as a soft magnetic material will tend to degrade, and it will become difficult to handle the powder. On the other hand, if the average particle size is not less than 100 μm, the eddy-current loss will increase and abnormal loss will tend to increase.

The soft magnetic alloy powder of the present invention can be obtained by a method similar to a well-known preparation method of soft magnetic alloy powder. In this case, the powder can be prepared by a gas atomizing method, a water atomizing method, a rotary disk method, or the like. Among these, the water atomizing method is preferable in order to facilitate the preparation of the soft magnetic alloy powder with desired magnetic characteristics.

The soft magnetic alloy powder making up the core 110 is coated in part or whole of the surface thereof with the insulator. The insulator is appropriately selected according to the characteristics of the magnetic core required. The insulator can be selected, for example, from a variety of organic polymer resin, silicone resin, phenol resin, epoxy resin, liquid glass, and so on. These are used singly or in a combination of two or more. These materials may also be used in combination with an inorganic material such as a molding aid. Although an amount of the insulator to be added differs according to the required characteristics of the magnetic core, the insulator can be added, for example, in the amount of approximately 1 to 10 mass % relative to the mass of the core 110. If the content of the insulator is over 10 mass %, the magnetic permeability will decrease and loss will tend to increase. On the other hand, if the content of the insulator is less than 1 mass %, insulation will tend to become harder to ensure. The content of the insulator is more preferably 1.5 to 5 mass % relative to the mass of the core 110.

An amount of the lubricant to be added can be approximately 0.1 to 1 mass % relative to the mass of the core 110; a desired content of the lubricant is 0.2 to 0.8 mass % and a more desired content of the lubricant is 0.3 to 0.8 mass % relative to the mass of the core 110. If the content of the lubricant is less than 0.1 mass %, it will become difficult to remove a molded product from the die after molding, and molding cracks will tend to occur. On the other hand, if the content of the lubricant is over 1 mass %, the green density will become lowered to decrease the magnetic permeability. The lubricant can be selected, for example, from aluminum stearate, barium stearate, magnesium stearate, calcium stearate, zinc stearate, strontium stearate, and so on. These are used singly or in combination of two or more. Among these, the lubricant is preferably aluminum stearate from the viewpoint that so-called springback is small.

A cross-linker may be further added in the soft magnetic alloy powder. When the cross-linker is added in, the mechanical strength can be increased without degradation of the magnetic characteristics of the core 110. A preferred content of the cross-linker is 10 to 40 parts by mass relative to 100 parts by mass of the insulator. An organotitanium-based cross-linker can be used as the cross-linker.

The inductance element 100 can be produced by a conventionally known production method, except that the soft magnetic alloy powder of the present invention is used as the material of the core 110. For example, the inductance element 100 may be produced through a soft magnetic alloy powder preparing step, an insulator coating step, a molding step, and a thermal treatment step. First, the soft magnetic alloy powder preparing step is to prepare the aforementioned soft magnetic alloy powder.

In the next insulator coating step, predetermined amounts of the soft magnetic alloy powder and the insulator are first mixed. In a case where the cross-linker is added in, the cross-linker is mixed with the soft magnetic alloy powder and the insulator. The mixing is performed with a press kneader or the like, preferably, at room temperature for 20-60 minutes. The resulting mixture is dried, preferably, at about 100 to 300° C. for 20 to 60 minutes. Then the dried mixture is pulverized to obtain the soft magnetic alloy powder coated with the insulator. Subsequently, the lubricant is added according to need into the soft magnetic alloy powder. After the addition of the lubricant, it is preferable to mix the mixture for 10 to 40 minutes.

In the next molding step, the coil 120 is located at a predetermined position in a die of a press machine and the interior of the die is filled with the magnetic powder consisting of the soft magnetic alloy powder coated with the insulator, so as to bury the coil 120 therein. Next, the magnetic powder is pressed to implement compaction thereof to obtain a molding. There are no particular restrictions on molding conditions in the compaction, and the molding conditions can be properly determined according to the shape and size of the soft magnetic alloy powder, the shape, size, and density of the powder magnetic core, and so on. For example, normally, the maximum pressure is approximately 100 to 1000 MPa and, preferably, approximately 100 to 600 MPa, and a time for holding the maximum pressure is approximately 0.1 second to one minute. If the molding pressure is too low, it will be hard to achieve satisfactory characteristics and mechanical strength. On the other hand, if the molding pressure is too high, the coil 120 will become likely to short-circuit.

In the next thermal treatment step, the molding obtained as described above is maintained, for example, at 150-300° C. for 15 to 45 minutes. This results in hardening the resin as the insulator in the molding and thereby obtaining the inductance element 100 composed of the core 110, which is a powder magnetic core (compact), and the coil 120.

A rust-proofing step of rust-proofing the inductance element 100 may be performed according to need, after the thermal treatment step. The rust-proofing can be implemented, for example, by spray-coating the inductance element 100 obtained as described above, with an epoxy resin or the like. A thickness of the coating by the spray coating is approximately 15 μm. It is preferable to perform a thermal treatment at 120-200° C. for 15 to 45 minutes, after completion of the rust-proofing step.

In the present embodiment described above, the core 110 consists mainly of the soft magnetic alloy powder containing the predetermined amount of Si. For this reason, the intraparticle resistance of the powder increases, so that the core loss of the core 110 can be adequately reduced, particularly, in the high-frequency region. Furthermore, that the soft magnetic alloy powder contains the predetermined amount of Si is also effective to promotion and maintenance of the soft magnetic property of the core 110. Furthermore, the core 110 has the hardness kept low, in spite of the inclusion of Si in the soft magnetic alloy powder, and this is the principal factor to keep moldability good as a core. The soft magnetic alloy powder as the principal ingredient of the core 110 contains the predetermined amount of Co. This adequately suppresses reduction in the saturation flux density and the Curie temperature even if Si is contained in the predetermined amount. Therefore, the core 110 makes it feasible to achieve sufficiently high magnetic characteristics, particularly, in the high temperature region (e.g., 100 to 200° C.) where the inductance element 100 operates, and sufficiently low core loss (hysteresis loss and eddy-current loss).

The core 110 can increase the magnetic permeability mainly because the soft magnetic alloy powder contains the predetermined amount of Si, and can enhance the superimposed DC current characteristic mainly because the powder contains the predetermined amount of Co. Therefore, the core 110 has an excellent soft magnetic property.

The inductance element 100 with the core 110 having the above-described characteristics can have sufficiently low loss and high inductance density at actual operating temperatures of electronic equipment. This inductance element 100 can achieve more downsizing than ever before and can effectively demonstrate its advantage when mounted, for example, on various members such as a notebook type personal computer, and an electronic device or a power supply part mounted on a mobile body used under severe temperature environments, e.g., an automobile, and such as an electronic circuit, a substrate, and a chip set using high-temperature operating semiconductors including SiC.

The above described the preferred embodiment of the present invention, but it is noted that the present invention is by no means limited to the above embodiment. The present invention can be modified in many ways without departing from the scope and spirit of the invention. In other embodiments of the present invention, for example, the element with the powder magnetic core according to the present invention is not limited to the inductance element, but may be one of various transformers and magnetic shield materials. These elements can be implemented in the well-known forms, except that the soft magnetic alloy powder of the present invention is used as the magnetic material in the powder magnetic core.

In the inductance element of the present invention, the coil does not always have to be buried in the powder magnetic core. The inductance element of this form may be, for example, one wherein the powder magnetic core has, for example, a core part of columnar shape (center leg), pot parts (outer legs) located with a space on the periphery side of the core part, and connection parts to connect the core part and the pot parts, and wherein the coil is wound around the core part.

Furthermore, the inductance element of the present invention is not limited to the so-called wire-wound type in which the coil as described above is wound, as long as it uses the powder magnetic core of the present invention. For example, the inductance element of the present invention may also be a so-called multilayer type inductance element in which printed conductor patterns are connected through vias, instead of the wire-wound coil. Another inductance element of the present invention may be a so-called thin film type inductance element which has a conductor of a planar spiral shape, instead of the wire-wound coil.

EXAMPLES

The present invention will be described below in further detail with examples, but it is noted that the present invention is by no means intended to be limited to these examples. In the examples below, the contents of Fe and Ni are based on the total mass of Fe and Ni, and the contents of Co and Si are based on the total mass of Fe, Ni, Co, and Si.

[Preparation of Soft Magnetic Alloy Powder]

First prepared were ingots, chunks (lumps), or shots (particles) of an Fe—Ni alloy, Fe element, Ni element, Co element, and Si element. Then they were mixed in compositions as listed in Tables 1 and 2 and put in a crucible placed in a water atomizing system. Next, using a work coil provided outside the crucible, the crucible was heated up to 1500° C. or more by high frequency induction in an inert atmosphere to melt the ingots, chunks, or shots in the crucible, and mix them, thereby obtaining a melt.

Next, the melt in the crucible was sprayed from a nozzle provided in the crucible, and at the same time as it, the sprayed melt was hit by a water flow under a high pressure (50 MPa) to be rapidly cooled, thereby preparing the soft magnetic alloy powder consisting of Fe—Ni-based particles. The average particle sizes are numerical values measured by a laser diffractometry particle size measuring apparatus.HELOS system (JEOL Ltd.).

TABLE 1

| | Fe (mass %) | Ni (mass %) | Co (mass %) | Si (mass %) | Average particle size (μm) |
|---|---|---|---|---|---|
| Comparative Example 1 | 55 | 45 | 0 | 0 | 23.41 |
| Comparative Example 2 | 55 | 45 | 0 | 1.5 | 36.06 |
| Comparative Example 3 | 55 | 45 | 0 | 2.8 | — |
| Comparative Example 4 | 55 | 45 | 0 | 3.15 | 31.43 |
| Comparative Example 5 | 55 | 45 | 0 | 4.5 | 37.13 |
| Example 22 | 55 | 45 | 2 | 8 | — |
| Example 23 | 55 | 45 | 2 | 12 | — |
| Example 1 | 55 | 45 | 3 | 1.5 | 42.67 |

TABLE 1-continued

| | Fe (mass %) | Ni (mass %) | Co (mass %) | Si (mass %) | Average particle size (μm) |
|---|---|---|---|---|---|
| Example 2 | 55 | 45 | 3 | 2 | 38.76 |
| Example 3 | 55 | 45 | 3 | 2.5 | 38.78 |
| Example 4 | 55 | 45 | 3 | 2.75 | 35.66 |
| Example 5 | 55 | 45 | 3 | 2.8 | — |
| Example 6 | 55 | 45 | 3 | 3 | 41.00 |
| Example 7 | 55 | 45 | 4 | 2.75 | 39.04 |
| Example 8 | 55 | 45 | 4 | 2.8 | — |
| Example 9 | 55 | 45 | 4.5 | 2.5 | 32.43 |
| Comparative Example 6 | 55 | 45 | 6 | 0 | — |
| Comparative Example 7 | 55 | 45 | 6 | 1 | — |
| Example 10 | 55 | 45 | 6 | 1.5 | 43.83 |
| Example 11 | 55 | 45 | 6 | 2 | 33.28 |
| Example 12 | 55 | 45 | 6 | 2.5 | 34.58 |
| Example 13 | 55 | 45 | 6 | 2.8 | — |
| Example 14 | 55 | 45 | 6 | 3 | — |
| Example 15 | 55 | 45 | 6 | 3.15 | — |
| Example 16 | 55 | 45 | 6 | 4.5 | — |
| Example 17 | 55 | 45 | 8 | 3 | 42.42 |
| Comparative Example 8 | 55 | 45 | 11.36 | 0 | — |
| Comparative Example 9 | 55 | 45 | 12 | 0 | 23.36 |

TABLE 2

| | Fe (mass %) | Ni (mass %) | Co (mass %) | Si (mass %) | Average particle size (μm) |
|---|---|---|---|---|---|
| Comparative Example 10 | 52.5 | 47.5 | 0.5 | 2 | — |
| Example 24 | 52.5 | 47.5 | 1.5 | 2 | — |
| Example 18 | 52.5 | 47.5 | 3 | 2 | — |
| Example 19 | 52.5 | 47.5 | 4.5 | 2.5 | — |
| Example 20 | 52.5 | 47.5 | 6 | 3 | 32.29 |
| Example 25 | 52.5 | 47.5 | 12 | 6 | — |
| Comparative Example 11 | 52.5 | 47.5 | 12 | 7 | — |
| Example 21 | 50 | 50 | 4.5 | 2.5 | — |
| Example 26 | 45 | 55 | 12 | 2 | — |
| Example 27 | 45 | 55 | 12 | 3 | — |
| Example 28 | 45 | 55 | 12 | 4 | — |

[Fabrication of Powder Magnetic Core]

A silicone resin (SR2414LV available from Dow Corning Toray Co., Ltd.) as an insulator and tributyltin as a hardening catalyst thereof were added by 2.4 mass % and by 0.4 mass %, respectively, relative to the total amount, in the resultant soft magnetic alloy powder, and they were mixed at room temperature for 30 minutes with a press kneader. Then the mixture was dried at 110° C. in air for 30 minutes. Aluminum stearate (SA-1000 available from Sakai Chemical Industry Co., Ltd.) as a lubricant was added by 0.4 mass % relative to the total amount, in the magnetic powder after dried, and they were mixed for 15 minutes by a V-mixer.

Subsequently, the resulting mixture was molded to obtain the powder magnetic core having the outside diameter: 17 mm, inside diameter: 10 mm, and thickness: 5 mm. The molding pressure was 490 MPa. The molding after pressed was thermally treated at 240° C. for 30 minutes to harden the silicone resin as the insulator, thereby obtaining the powder magnetic core.

[Various Evaluations]

(Intraparticle Resistance Measurement)

The intraparticle resistance of the soft magnetic alloy powder in the powder magnetic cores of Examples 10, 13, 15, and 16 and Comparative Examples 6 and 7 was measured by the van der Pauw method with an atomic force microscope. The results are presented in Table 3 and FIG. 2. In FIG. 2 the horizontal axis represents the content of Si.

TABLE 3

| | Intraparticle resistivity (μΩcm) | Saturation magnetization at room temperature (T) | Curie temperature (° C.) |
|---|---|---|---|
| Comparative Example 1 | — | 1.467 | 484 |
| Comparative Example 2 | — | 1.381 | 377 |
| Comparative Example 3 | — | 1.243 | 323 |
| Comparative Example 4 | — | — | — |
| Comparative Example 5 | — | 1.023 | — |
| Example 22 | — | 1.48 | 474 |
| Example 23 | — | 1.48 | 487 |
| Example 1 | — | 1.442 | 412 |
| Example 2 | — | 1.339 | — |
| Example 3 | — | 1.319 | 366 |
| Example 4 | — | 1.293 | — |
| Example 5 | — | — | — |
| Example 6 | — | 1.256 | — |
| Example 7 | — | 1.31 | 368 |
| Example 8 | — | — | — |
| Example 9 | — | 1.332 | 385 |
| Comparative Example 6 | 38.2 | — | — |
| Comparative Example 7 | 55.5 | — | — |
| Example 10 | 81.9 | 1.494 | 443 |
| Example 11 | — | 1.384 | 419 |
| Example 12 | — | 1.312 | 396 |
| Example 13 | 86.7 | — | — |
| Example 14 | — | 1.293 | — |
| Example 15 | 92.7 | — | — |
| Example 16 | 80.5 | — | — |
| Example 17 | — | 1.273 | — |
| Comparative Example 8 | — | 1.28 | 586 |
| Comparative Example 9 | — | 1.023 | — |

It was found from the results of this measurement that the intraparticle resistance suddenly increased as the content of Si became 1.2 mass % or more.

(Core Loss Measurement)

Figure 3:
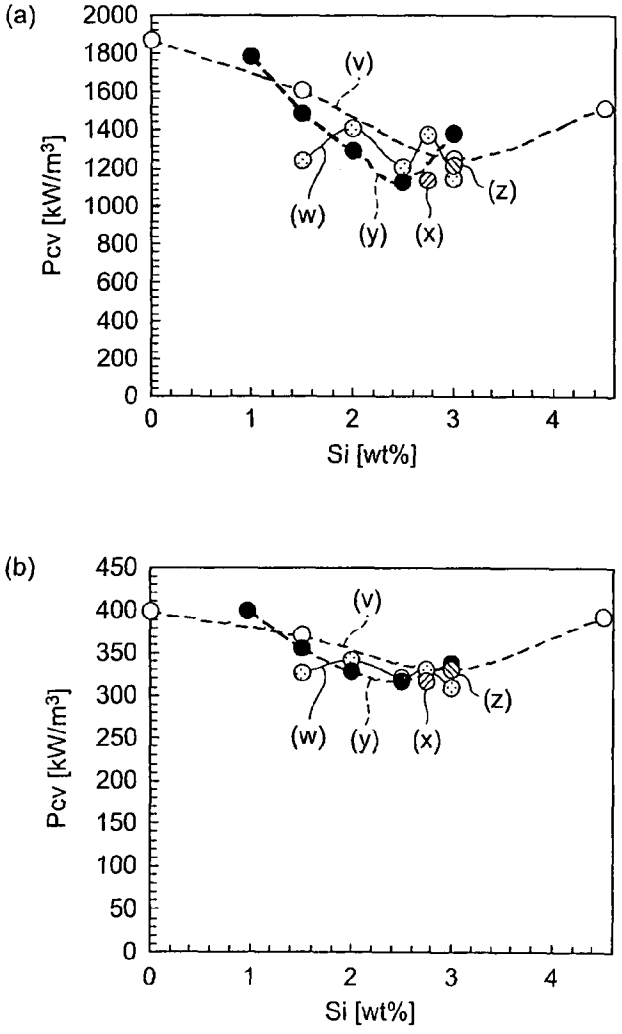
FIG. 3 is graphs showing core losses of powder magnetic cores in Examples.

The core loss (Pcv) was measured under the applied magnetic field of 25 mT, for each of the resultant powder magnetic cores of Examples 1-3, 5, 6, 8, 10-12, 14, and 17 and Comparative Examples 1, 2, 4, and 5. The results are presented in FIG. 3. In FIG. 3(*a*) shows the core losses in the high frequency region (1 MHz) and (*b*) the core losses in the low frequency region (0.3 MHz), and the horizontal axis represents the content of Si. In the same drawing, (v), (w), (x), (y), and (z) indicate the core losses in the cores where the Co content is 0, 3, 4, 6, or 8 mass % in order. It was confirmed that the addition of 1.2 mass % or more Si lowered the core loss of the powder magnetic core and the core loss became significantly lowered, particularly, in the high frequency region. It was also found that maintenance or further reduction of core loss was recognized by increasing the Co content to 1 mass % or more.

(Measurement of Magnetic Permeability and Superimposed DC Current Characteristic)

Figure 4:
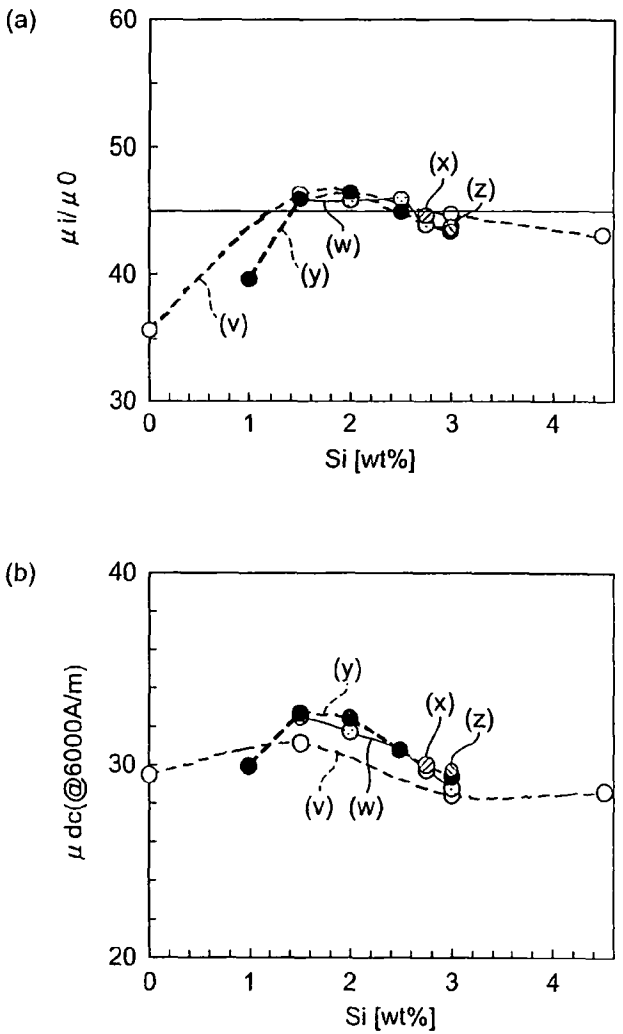
FIG. 4 is graphs showing magnetic permeabilities and superimposed DC current characteristics of powder magnetic cores in Examples.

The magnetic permeability (μi/μ0) at 0.3 MHz and the superimposed DC current characteristic (μdc) with application of a bias magnetic field of 6000 A/m were measured for each of the powder magnetic cores of Examples 1-3, 5, 6, 8, 10-12, 14, and 17 and Comparative Examples 1, 2, 4, and 5. The results are presented in FIG. 4. In FIG. 4(*a*) shows the magnetic permeabilities and (*b*) the superimposed DC current characteristics, and the horizontal axis represents the content of Si. In the same drawing, (v), (w), (x), (y), and (z) indicate the magnetic permeabilities and the superimposed DC current characteristics in the cores where the Co content is 0, 3, 4, 6, or 8 mass % in order. It was confirmed that the addition of 1.2 mass % or more Si increased the magnetic permeability to 45. It was also confirmed that the inclusion of 1 mass % or more Co enhanced the superimposed DC current characteristic.

(Measurement of Vickers Hardness)

Figure 5:
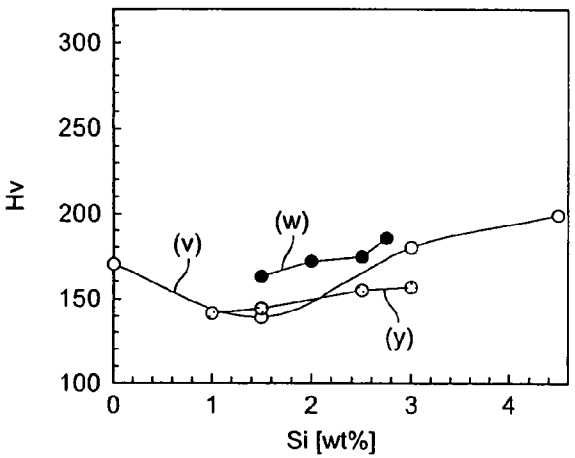
FIG. 5 is a graph showing Vickers hardnesses of powder magnetic cores in Examples.

The Vickers hardness (Hv) was measured with a well-known micro-Vickers hardness tester, for each of the powder magnetic cores of Examples 1-3, 5, 10, 12, and 14 and Comparative Examples 1, 2, 4, and 5. The results are presented in FIG. 5. In FIG. 5, (v), (w), and (y) indicate the Vickers hardnesses in the cores where the Co content is 0, 3, or 6 mass % in order, and the horizontal axis represents the content of Si. Since all the powder magnetic cores have the same composition of the materials other than the soft magnetic alloy powders, the numerical values of Vickers hardness are presumed to depend upon the hardnesses of the soft magnetic alloy powders. It was, therefore, confirmed by the results shown in FIG. 5 that the hardnesses of the powder magnetic cores and the soft magnetic alloy powders were kept low in spite of the addition of Si.

Figure 10:
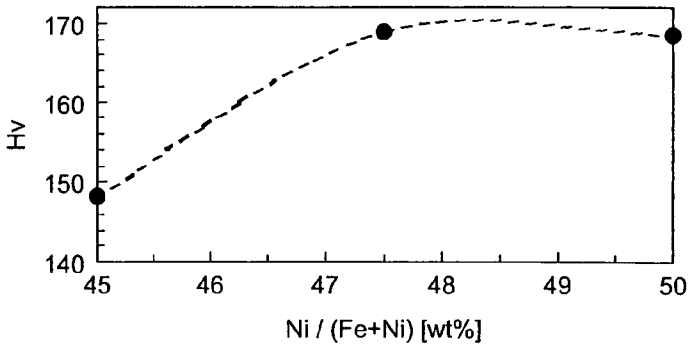
FIG. 10 is a graph showing Vickers hardnesses of powder magnetic cores in Examples.

The Vickers hardness (Hv) was also measured in the same manner as above, for each of the powder magnetic cores of Examples 9, 19, and 21. The results are presented in FIG. 10. In FIG. 10 the horizontal axis represents the content of Ni. It was confirmed by this result that the increase of the Ni content to 47 mass % or more increased the hardness of the soft magnetic alloy powder but it would pose no problem in practical use.

(Measurement of Saturation Magnetization at Room Temperature)

Figure 7:
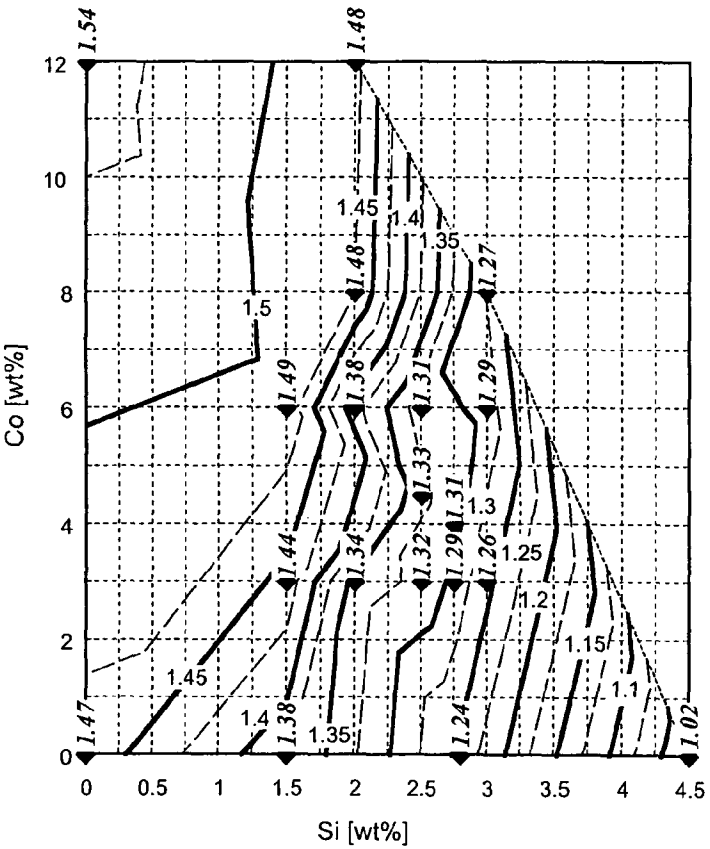
FIG. 7 is a contour drawing showing saturation magnetizations at room temperature of soft magnetic alloy powders in Examples.

The saturation magnetization (Is) at room temperature was measured with a well-known vibrating sample magnetometer (VSM), for each of the soft magnetic alloy powders of Examples 1-4, 6, 9-12, 14, 17, 22, and 23 and Comparative Examples 1-3, 5, and 9. The results are presented in Tables 3 and 4 and FIG. 7. FIG. 7 shows contours of saturation magnetization, the horizontal axis represents the content of Si, the vertical axis represents the content of Co, and numerical values of saturation magnetization are plotted corresponding to contents of Co and Si. It was confirmed by these results that the addition of Si decreased the saturation magnetization and this tendency became prominent, particularly, as the content of Si exceeded 2 mass %, and that the addition of 1 mass % or more Co increased the saturation magnetization and adequately suppressed the reduction of saturation magnetization. Particularly, the reduction suppressing effect of saturation magnetization was significant when Co was added by 1 mass % or more at low Si contents.

TABLE 4

| | Saturation magnetization at room temperature (T) | Curie temperature (° C.) |
|---|---|---|
| Comparative Example 10 | 1.37 | 426 |
| Example 24 | 1.39 | 436 |
| Example 18 | 1.37 | 428 |
| Example 19 | 1.34 | 416 |

TABLE 4-continued

| | Saturation magnetization at room temperature (T) | Curie temperature (° C.) |
|---|---|---|
| Example 20 | 1.29 | 411 |
| Example 25 | 1.07 | 349 |
| Comparative Example 11 | 0.98 | 314 |
| Example 21 | 1.32 | 460 |
| Example 26 | 1.38 | 570 |
| Example 27 | 1.32 | 535 |
| Example 28 | 1.23 | 476 |
| Example 21 | 1.32 | 460 |

Figure 9:
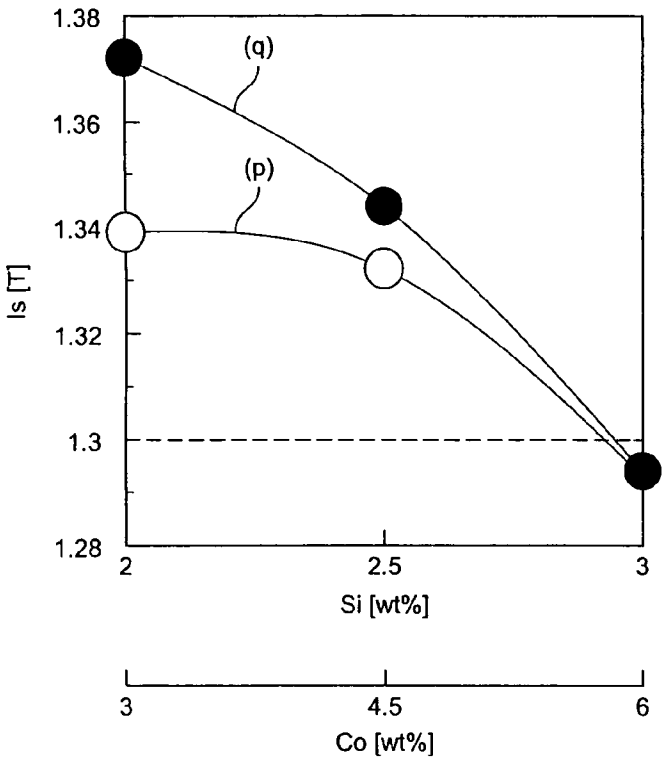
FIG. 9 is a contour drawing showing saturation magnetizations at room temperature of soft magnetic alloy powders in Examples.

The saturation magnetization (Is) at room temperature was also measured in the same manner as above, for each of the soft magnetic alloy powders of Examples 18-20. The results are presented in Table 4 and FIG. 9. In FIG. 9, the results of Examples 2, 9, and 14 are also plotted in addition to those of the above examples, (p) indicates the saturation magnetization (Is) where the Ni content is 45 mass %, and (q) the saturation magnetization (Is) where the Ni content is 47.5 mass %. FIG. 9 shows changes of saturation magnetization (Is) at room temperature with change of composition from the composition of the Co content of 3 mass % and the Si content of 2 mass % to the composition of the Co content of 6 mass % and the Si content of 3%. It was found from this result that the enhancing effect of saturation magnetization by the Ni content of 47 mass % or more was recognized, particularly, at low Si and Co contents.

(Measurements of Temperature Characteristic of Saturation Magnetization, and Curie Temperature)

Figure 6:
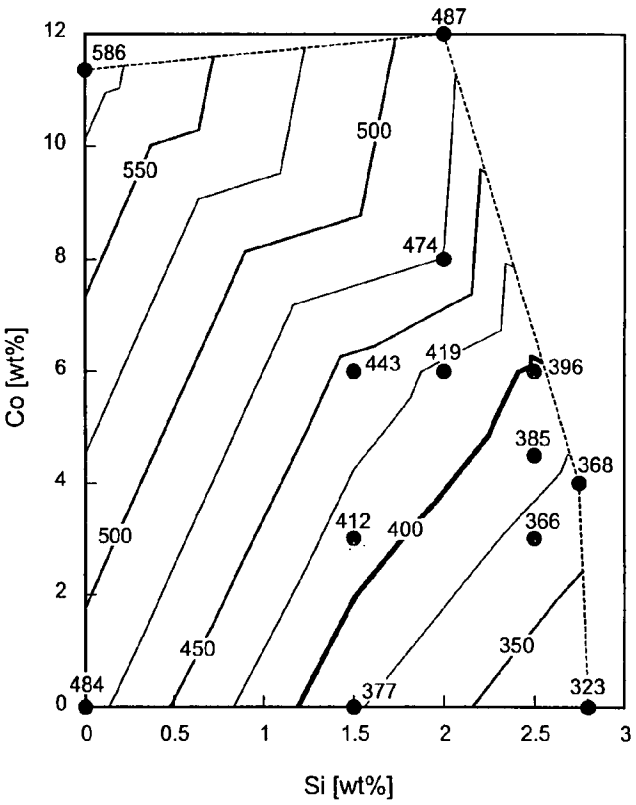
FIG. 6 is a contour drawing showing Curie temperatures of soft magnetic alloy powders in Examples.

For each of the soft magnetic alloy powders of Examples 1, 3, 7, 9-12, 22, and 23 and Comparative Examples 1-3, and 8, the thermomagnetic property was measured with a well-known vibrating sample magnetometer (VSM) to measure the temperature characteristic of saturation magnetization (Is) and to obtain the Curie temperature (Tc). A temperature increase rate was 200° C./h. The results of Curie temperature (Tc) are presented in Tables 3 and 4 and FIG. 6. FIG. 6 shows contours of Curie temperature, the horizontal axis represents the content of Si, the vertical axis represents the content of Co, and numerical values of Curie temperature are plotted corresponding to contents of Co and Si. It was confirmed by these results that the addition of Si indicated a tendency to lower the Curie temperature, and the additional addition of 1 mass % or more Co increased the Curie temperature, whereby the reduction of Curie temperature was adequately suppressed. It was found that within the scope of the present invention the Curie temperature was attained as being equivalent to or better than that of the conventional permalloy B containing neither Co nor Si.

Figure 8:
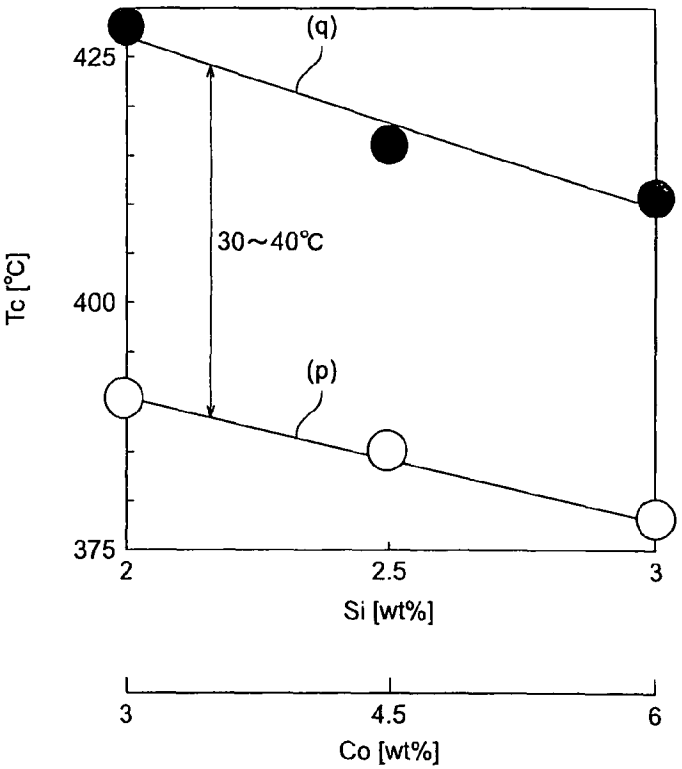
FIG. 8 is a graph showing Curie temperatures of soft magnetic alloy powders in Examples.

The Curie temperature (Tc) was obtained in the same manner as above, for each of the soft magnetic alloy powders of Examples 2, 14, and 18-20. The results are presented in FIG. 8. In FIG. 8, the result of Example 9 is also plotted in addition to those of the above examples, (p) indicates the Curie temperature (Tc) where the Ni content is 45 mass %, and (q) the Curie temperature (Tc) where the Ni content is 47.5 mass %. FIG. 8 shows changes of Curie temperature (Tc) with change of composition from the composition of the Co content of 3 mass % and the Si content of 2 mass % to the composition of the Co content of 6 mass % and the Si content of 3%. It was found from this result that the enhancing effect of Curie temperature was recognized by setting the Ni content to 47 mass % or more.

Furthermore, the temperature characteristic of saturation magnetization (Is) was also measured in the same manner as above, and the Curie temperature (Tc) was also obtained, for each of the soft magnetic alloy powders of Examples 18-21. The results of Curie temperature are presented in Table 4.

Figure 12:
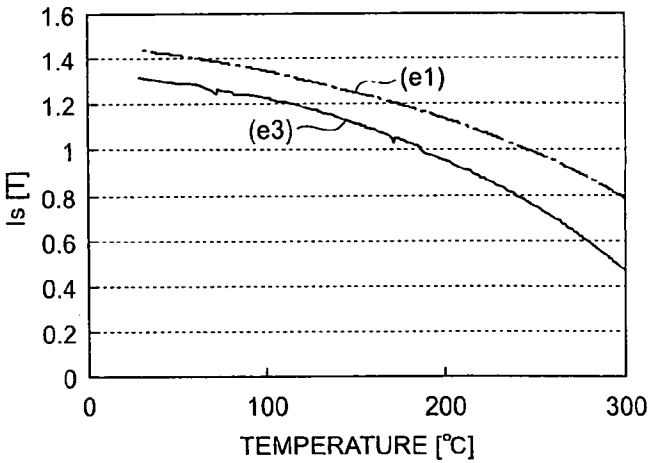
FIG. 12 is a chart showing temperature characteristics of saturation magnetization of soft magnetic alloy powders in Examples.
Figure 11:
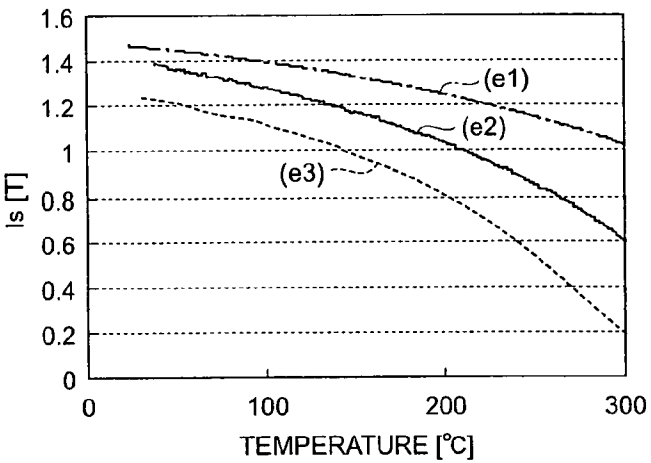
FIG. 11 is a chart showing temperature characteristics of saturation magnetization of soft magnetic alloy powders in Examples.
Figure 14:
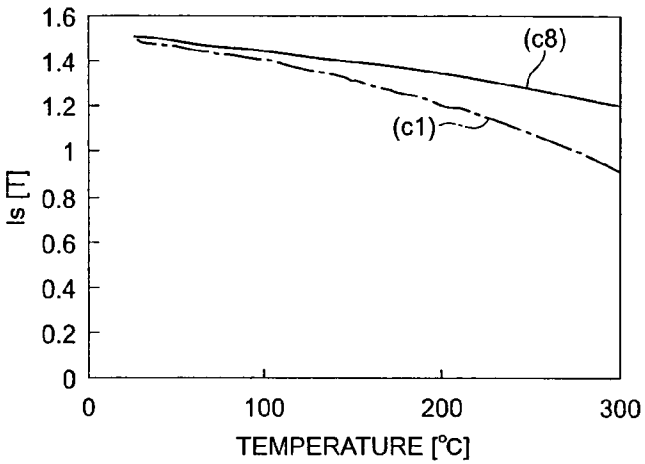
FIG. 14 is a chart showing temperature characteristics of saturation magnetization of soft magnetic alloy powders in Examples.
Figure 13:
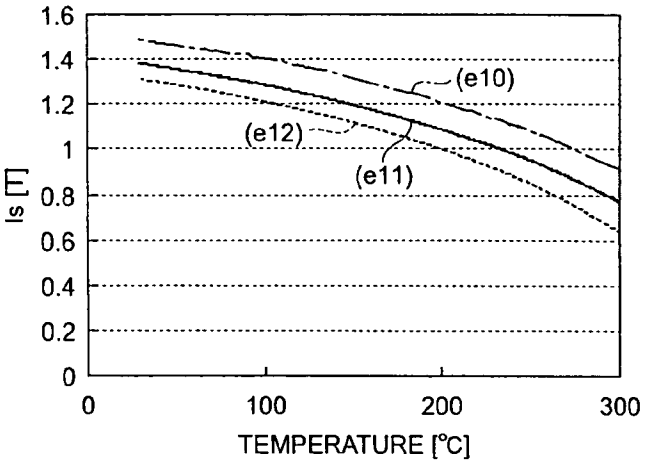
FIG. 13 is a chart showing temperature characteristics of saturation magnetization of soft magnetic alloy powders in Examples.
Figure 16:
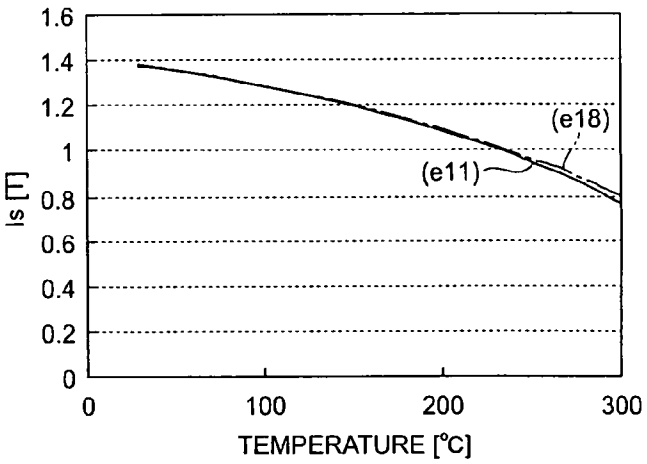
FIG. 16 is a chart showing temperature characteristics of saturation magnetization of soft magnetic alloy powders in Examples.
Figure 15:
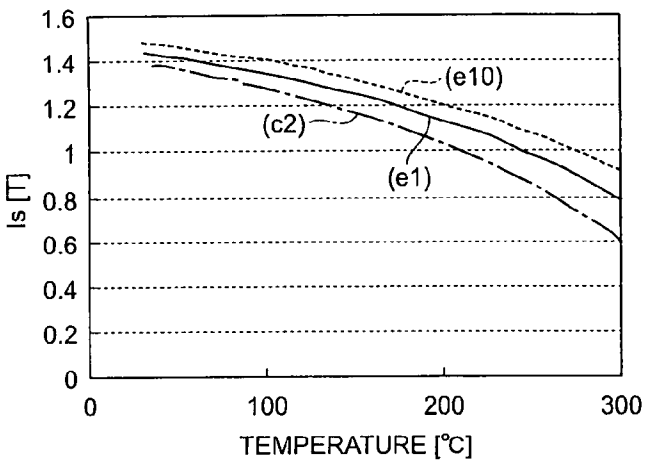
FIG. 15 is a chart showing temperature characteristics of saturation magnetization of soft magnetic alloy powders in Examples.
Figure 18:
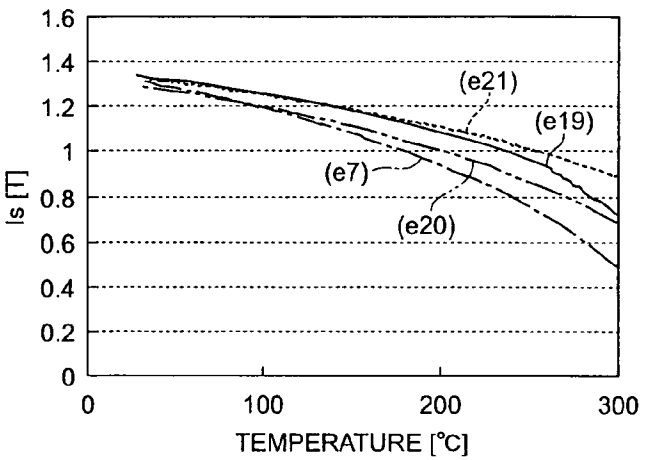
FIG. 18 is a chart showing temperature characteristics of saturation magnetization of soft magnetic alloy powders in Examples.
Figure 17:
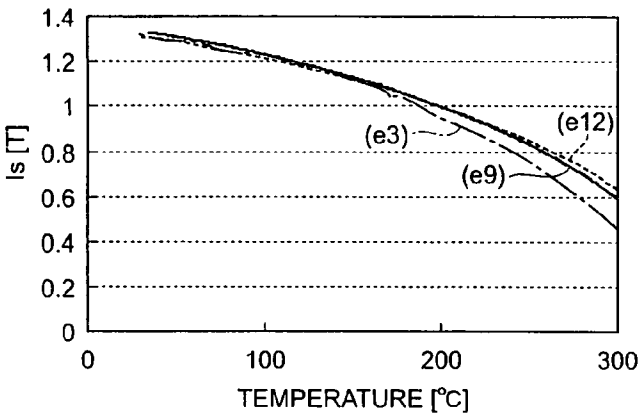
FIG. 17 is a chart showing temperature characteristics of saturation magnetization of soft magnetic alloy powders in Examples.

FIGS. 11 to 18 show temperature characteristics of saturation magnetization (Is) of Examples 1, 3, 7, 9-12, and 18-21 and Comparative Examples 1-3 and 8. The examples are denoted by symbols of respective plots, (e1), (e3) . . . , and the comparative examples by (c1), (c2) . . . , in which numerals subsequent to e or c represent numbers of the examples or comparative examples. FIGS. 11 to 13 are drawing in each of which samples different only in the Si content are shown on the same chart. FIGS. 14 to 17 are drawings in each of which samples different only in the Co content are presented on the same chart.

In addition to Examples 18 to 20 above, the Curie temperature, saturation magnetization, Vickers hardness, magnetic permeability, superimposed DC current characteristic, and core loss were also measured in the same manner as above, for each of the powder magnetic cores or the soft magnetic alloy powders of Examples 24 and 25 and Comparative Examples 10 and 11. The results are presented in Table 5.

TABLE 5

| | Co (mass %) | Si (mass %) | Curie temperature (° C.) | Saturation magnetization at room temperature (T) | Vickers hardness Hv | Permeability μi/μ0 | Superimposed DC current characteristic μdc/μ0 | Core loss Pcv (kW/m$^3$) |
|---|---|---|---|---|---|---|---|---|
| Comparative Example 10 | 0.5 | 2 | 426 | 1.37 | 157 | 39.4 | 28.7 | 385 |
| Example 24 | 1.5 | 2 | 436 | 1.39 | 160 | 40.9 | 29.2 | 355 |
| Example 18 | 3 | 2 | 428 | 1.37 | 167 | 44.5 | 30.8 | 345 |
| Example 19 | 4.5 | 2.5 | 416 | 1.34 | 169 | 48.4 | 30.9 | 374 |
| Example 20 | 6 | 3 | 411 | 1.30 | 162 | 39.5 | 28.8 | 323 |
| Example 25 | 12 | 6 | 349 | 1.07 | 245 | 29.1 | 20.6 | 475 |
| Comparative Example 11 | 12 | 7 | 314 | 0.98 | 287 | 25.4 | 18.6 | 609 |

Table 5 shows each of the above-described magnetic characteristics in cases where the Ni content is 47.5 mass % (the content of Fe is 52.5 mass %) and where the contents of Si and Co are changed. When the Si content was increased by 3 mass % from 3 mass % to 6 mass %, the Curie temperature was lowered by about 50° C. In contrast to it, it was also found by a comparison between Example 25 and Comparative Example 11 that the Curie temperature was lowered by as much as about 35° C. when the Si content was increased by only 1 mass % from 6 mass % to 7 mass %. Moreover, the magnetic permeability decreased while the core loss substantially increased between the powder magnetic cores of Example 25 and Comparative Example 11. It can be judged from these that the object of the present invention can be achieved even if the Si content is as large as 6.5 mass %.

From a comparison between Comparative Example 10 and Example 24, the core loss is decreased by 30 kW/m$^3$ when the Co content is increased from 0.5 mass % to 1.5 mass %. Furthermore, since the magnetic permeability and Curie temperature also become better, it can be judged that the object of the present invention can also be achieved even if the Co content is as low as 1 mass %.

The Vickers hardness is preferably as low as possible in terms of easy molding of the powder magnetic core for mass production of elements such as the inductance elements, and the upper limit thereof is preferably approximately 250. If the value of Vickers hardness is higher than it, it will be difficult to perform molding and, where the molding is performed together with the coil conductor, the softer conductor becomes likely to be damaged. From a comparison between Example 25 and Comparative Example 11, the Vickers hardness suddenly increased from 245 to 287 when the Si content was increased by only 1 mass % from 6 mass % to 7 mass %. It can be judged from this result that the excellent hardness for moldability can be maintained even if the contents of Si and Co are as high as 6.5 mass % and 12 mass %, respectively.

Furthermore, the saturation magnetization was kept not less than 1 T in Example 25, whereas it was less than 1 T in Comparative Example 11, which was the result lacking in practicality.

Figure 19:
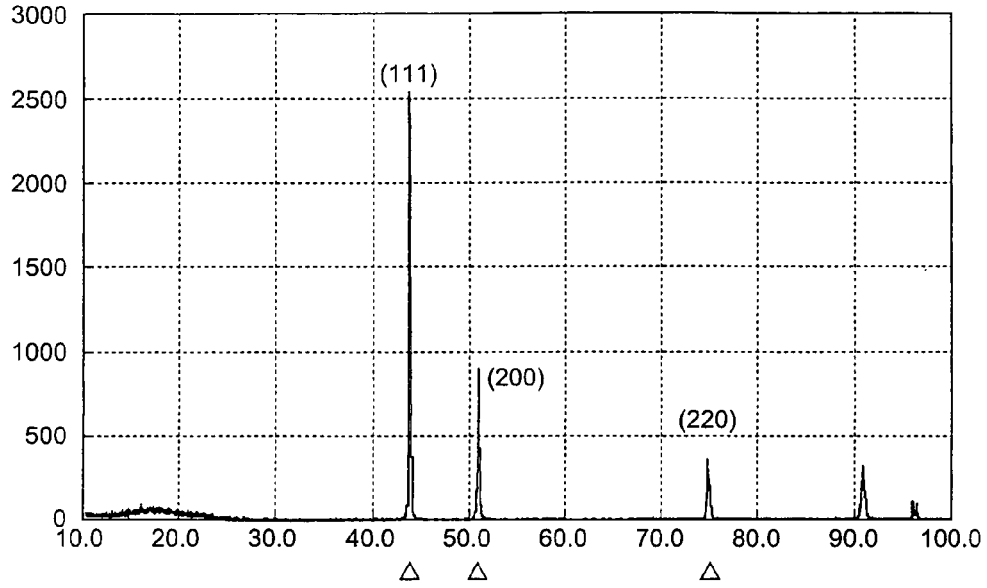
FIG. 19 is a drawing showing an XRD chart of a soft magnetic alloy powder in Example.
Figure 20:
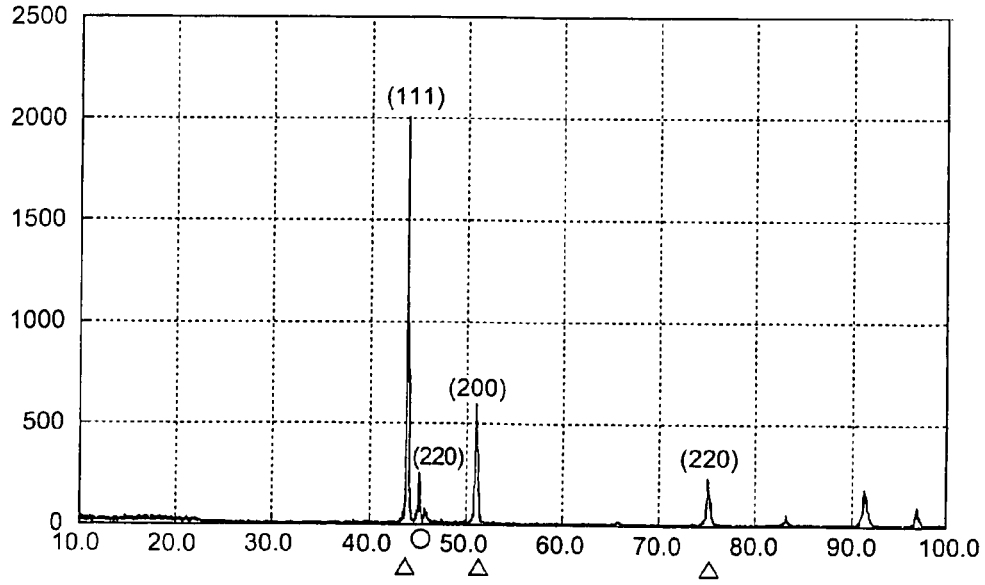
FIG. 20 is a drawing showing an XRD chart of a soft magnetic alloy powder in Comparative Example.

The crystal structure was checked by X-ray diffraction, for each of the soft magnetic alloy powders of Example 24 and Comparative Example 11 among the above-described soft magnetic alloy powders. XRD charts of the results are presented in FIGS. 19 and 20. FIG. 19 is the XRD chart of the powder magnetic core of Example 24 and FIG. 20 the XRD chart of the powder magnetic core of Comparative Example 11. In the drawings, peaks indicated by "Δ" are based on crystal faces of M-phases (M=3d transition metals (Fe, Ni, Co)), and a peak indicated by "○" is based on a crystal face of $M_3Si$ phase. Only the peaks based on the 3d transition metal phases were recognized in the XRD chart of Example 24, whereas the peak based on the (220) face of the $M_3Si$ phase, which was not recognized in the XRD chart of Example 24, appeared in the XRD chart of Comparative Example 11. It is presumed from this result that when the Si content exceeds 6.5 mass %, the hetero-phase other than the M-phases becomes likely to appear and this causes a large change in the magnetic characteristics.

The Curie temperature, saturation magnetization, Vickers hardness, magnetic permeability, superimposed DC current characteristic, and core loss were measured in the same manner as above, for each of the powder magnetic cores or the soft magnetic alloy powders of Examples 26 to 28. The results are presented in Table 6.

TABLE 6

| | Si (mass %) | Curie temperature (° C.) | Saturation magnetization at room temperature (T) | Vickers hardness Hv | Permeability μi/μ0 | Superimposed DC current characteristic μdc/μ0 | Core loss Pcv (kW/m$^3$) |
|---|---|---|---|---|---|---|---|
| Example 26 | 2 | 570 | 1.38 | 155 | 47.2 | 31.5 | 373 |
| Example 27 | 3 | 535 | 1.32 | 177 | 40.5 | 28.5 | 341 |
| Example 28 | 4 | 476 | 1.23 | 203 | 40.5 | 27.3 | 344 |

Table 6 shows each of the above-described magnetic characteristics in cases where the Ni content is 55 mass % (the Fe content is 45 mass %), the Co content is 12 mass %, and the Si content is changed. As apparent from these results, the high magnetic permeability and low core loss were also achieved even in the cases where the Ni content was as high as 55 mass %; in addition, the saturation magnetization obtained was as high as 1.2 to 1.4 T, and the Vickers hardness was also the values low enough to ensure good moldability.

What is claimed is:

1. A soft magnetic alloy powder comprising Fe—Ni-based particles containing 45 to 55 mass % Fe and 45 to 55 mass % Ni, relative to a total mass of Fe and Ni, and containing 1 to 12 mass % Co and 1.2 to 6.5 mass % Si, relative to a total mass of Fe, Ni, Co, and Si.

2. The soft magnetic alloy powder according to claim 1, wherein the Fe—Ni-based particles has an average particle size of more than 10 μm and less than 100 μm.

3. A compact comprising Fe—Ni-based particles a part or whole of a surface of which is coated with an insulator, wherein said Fe—Ni-based particles contain 45 to 55 mass % Fe and 45 to 55 mass % Ni, relative to a total mass of Fe and Ni, and contain 1 to 12 mass % Co and 1.2 to 6.5 mass % Si, relative to a total mass of Fe, Ni, Co, and Si.

4. An inductance element comprising a powder magnetic core comprised of a compact, wherein the compact comprises Fe—Ni-based particles a part or whole of a surface of which is coated with an insulator, wherein said Fe—Ni-based particles contain 45 to 55 mass % Fe and 45 to 55 mass % Ni, relative to a total mass of Fe and Ni, and contain 1 to 12 mass % Co and 1.2 to 6.5 mass % Si, relative to a total mass of Fe, Ni, Co, and Si.

5. An inductance element comprising a powder magnetic core comprised of a compact, and a coil buried in the powder magnetic core, wherein the compact comprises Fe—Ni-based particles a part or whole of a surface of which is coated with an insulator, wherein said Fe—Ni-based particles contain 45 to 55 mass % Fe and 45 to 55 mass % Ni, relative to a total mass of Fe and Ni, and contain 1 to 12 mass % Co and 1.2 to 6.5 mass % Si, relative to a total mass of Fe, Ni, Co, and Si.

* * * * *